United States Patent [19]

Mishra et al.

[11] Patent Number: 4,487,589

[45] Date of Patent: Dec. 11, 1984

[54] METHOD OF PREPARING ELECTRON EMISSIVE COATINGS FOR ELECTRIC DISCHARGE DEVICES

[75] Inventors: Amarendra Mishra, Lyndhurst; Dimitri M. Speros, Painesville; Roger M. Eastin, South Euclid, all of Ohio

[73] Assignee: General Electric Company, Schenectady, N.Y.

[21] Appl. No.: 503,927

[22] Filed: Jun. 13, 1983

Related U.S. Application Data

[62] Division of Ser. No. 275,834, Jun. 22, 1981, Pat. No. 4,415,835.

[51] Int. Cl.[3] ..... H01J 9/04

[52] U.S. Cl. ..... 445/51

[58] Field of Search ..... 445/51; 313/346 R

[56] References Cited

U.S. PATENT DOCUMENTS

| | | | |
|---|---|---|---|
| 2,749,467 | 6/1956 | Rigden | 313/346 DC |
| 3,238,596 | 3/1966 | Rich et al. | 445/51 |
| 3,558,964 | 1/1971 | White | 313/346 R X |
| 3,911,309 | 10/1975 | Kummel | 313/346 R |
| 3,988,629 | 10/1976 | White et al. | 313/346 R X |
| 4,097,762 | 6/1978 | Hilton et al. | 313/346 R X |
| 4,123,685 | 10/1978 | Bhalla | 313/346 R |
| 4,152,620 | 5/1979 | Bhalla | 313/346 R |
| 4,250,429 | 2/1981 | Lersmacher et al. | 313/346 R |
| 4,275,330 | 6/1981 | Cho et al. | 313/346 R X |
| 4,303,848 | 12/1981 | Shimizu et al. | 313/346 R |
| 4,310,773 | 1/1982 | Zukowski et al. | 313/221 |

*Primary Examiner*—Kenneth J. Ramsey

*Attorney, Agent, or Firm*—John F. McDevitt; Philip L. Schlamp; Fred Jacob

[57] ABSTRACT

An electric discharge type device is described having electrode means which include a refractory metal substrate having sintered thereon an open porous coating of refractory metal particles at a thickness up to about 1 millimeter thickness with electron emissive material being disposed in the pores of said sintered refractory metal coating. Representative electric discharge devices having said improved electrode means include discharge type electric lamps and photographic flash tubes wherein the electrode members have an elongated shaped body which is terminated at one end to provide more surface area for the coatings sintered thereon. Various electron emissive materials can be employed for impregnation of the open porous coating of refractory metal particles by such conventional techniques as dipping or spraying.

1 Claim, 2 Drawing Figures

METHOD OF PREPARING ELECTRON EMISSIVE COATINGS FOR ELECTRIC DISCHARGE DEVICES

This is a division of application Ser. No. 275,834, filed June 22, 1981 and now U.S. Pat. No. 4,415,835.

BACKGROUND OF THE INVENTION

This invention pertains to improved electron emissive coatings which can be easily fabricated in miniature form for use in various electron discharge devices which are also now being introduced in smaller sizes such as photographic flash tubes and electric discharge lamps. More particularly, this invention relates to electron emissive coatings of a relatively minor thickness which can be sintered to a refractory metal substrate having various shapes and which exhibit performance characteristics fully equal or superior to the conventional electron emission means.

In U.S. Pat. No. 4,275,330, issued June 23, 1981 and assigned to the assignee of present invention, there is described electron emission means in the form of a porous sintered refractory metal body such as a sintered tungsten pellet which is impregnated with various refractory metal interoxides to provide improved resistance to deterioration in a discharge lamp operating environment. Problems exist in the fabrication of the pressed refractory metal pellets used in this type electrode which are aggravated with miniaturization of the discharge lamp device often leading to high shrinkage and lack of reproducible electrode preformance along with higher costs. Assembly of this type electrode member further entails joinder of the pressed pellet to a refractory metal shank when the discharge lamp is constructed which also leads to higher costs than would occur with a single piece electrode construction. In a now abandoned application, Ser. No. 039,266, filed May 16, 1979, in the names of J. C. Sobieski, J. E. Spencer, G. L. Thomas, and E. C. Zukowski, and assigned to the present assignee, there is described an all glass type flash tube using the same type electrode construction. Specifically, the cathode member in said electric discharge device can comprise a molybdenum body shank having secured thereto by conventional means a pressed sintered pellet of tantalum or some other suitable refractory metal which is impregnated with a suitable emission material for this type lamp or device operation to include barium aluminate and barium tungstate materials as well as still other known interoxides.

In a more recently filed still pending application Ser. No. 161,431, filed June 20, 1980 in the names of R. K. Datta and D. M. Speros, also assigned to the present assignee, electron emitting coatings are disclosed for use in a metal halide arc lamp which comprise a coating of the electron emission material being deposited on the cathode member having an elongated shaped body of tungsten metal which can terminate in a balled end by melting back the tungsten shank. Said one piece electrode construction employs a coating of the emission material which is deposited on the balled end of the tungsten shank as oxides of scandium and dysprosium or borides of thorium, scandium and lanthanum for improved performance in this type lamp. The cathode member in such lamp construction can further employ a tungsten helix wound about the tungsten shank and with the electron emission coating being disposed between the helix turns and the shank.

It would be generally desirable to simplify the cathode member contruction for all type electric discharge devices and by means enhancing size reduction of the device itself. It would be further desirable to simplify said cathode member construction in a manner which does not sacrifice any of the desirable operating characteristics during device operation.

SUMMARY OF THE INVENTION

It has now been discovered, surprisingly, that a novel electron emission means for various electric discharge devices to include electric discharge lamps and photographic flash tubes is provided by sintering a thin porous coating of refractory metal directly to the surface of a refractory metal support serving as the electrode body member and thereafter impregnating the open pores in said metal coating with a suitable electron emissive material. It becomes possible in this manner to fabricate the body member of the final electrode structure in various forms which can improve operation of the particular electric discharge device employing the novel electrodes and thereafter sinter the thin refractory metal coatings to these preshapes. The required thickness of the porous refractory metal coating in the present cathode member construction has not been found especially critical with thicknesses up to about one millimeter thickness providing sufficient thickness to operate effectively in the selected electric discharge device when impregnated with conventional electron emissive materials in the customary manner such as by a simple dipping process. Correspondingly, the size of the refractory metal particles which are sintered to provide an open porous coating on the selected refractory metal substrate has not proved critical in final device operation so that a wide variety of commercially available refractory metal powders can be used with comparable results.

Basically, the improved cathode member for an electric discharge device thereby comprises a refractory metal substrate having sintered thereon an open porous coating of refractory metal particles at a thickness up to about 1 millimeter thickness and with electron emissive material being disposed in the pores of the sintered refractory metal coating. In one of its preferred embodiments, a photographic flash tube of the all glass type is constructed having sealed within the transparent glass envelope a pair of spaced apart discharge electrodes prepared in accordance with the present invention in the form of a hair pin configuration to lower the electrical operating requirements in said device. In a different preferred electric discharge lamp embodiment, the electrode members are formed from a refractory metal shank which is terminated at one end to provide more surface area for the coating sintered hereon such as provided with a balled end or flattened head. Suitable emission materials for impregnation of the first metal coating in the aforementioned photographic flash tube device include barium aluminate and barium tungstate materials as well as still other known interoxides. An especially preferred electron emissive material for said device is disclosed in U.S. Pat. No. 4,275,330 wherein cesium is dispersed in the pores of said porous sintered coating as $Cs_2MoO_4$ with said electron emissive material being preferably employed in combination with another electron emissive material containing barium ions to provide a lower breakdown voltage as well as operating voltage characteristic in this type device. Similarly, suitable electron emissive material for an electric discharge lamp of the metal halide arc type are disclosed in aforementioned pending patent application Ser. No. 161,431. The highly reactive atmosphere in said lamps causes reaction with the alkaline earth oxides commonly employed as electron emissive materials which advises subsstitution of less reactive oxides of scandium and dysprosium and borides of thorium, scandium and lanthanum as the electron emission material in said lamps.

Proper sintering of the present thin porous metallic coating to the refractory metal substrate requires heating the coated electrode member to a sufficiently elevated temperature and which depends upon the sintering temperature of the particular refractory metal being employed in said coating. While it is not essential that the actual sintering temperature of the selected refractory metal particles be reached in order to secure an open porous structure which adequately bonds to the refractory metal substrate, the elevated temperature employed for this bonding operation has been found to influence certain operational characteristics in the electric discharge device. For example, tests conducted upon the type photographic flash tube disclosed in the previously mentioned pending application Ser. No. 039,266 found the amount of light output during lamp life to depend upon the temperature at which sintering of the porous metallic coating in the present electrodes took place. The present lamp tests were conducted on model FT-9 and FT-19 flash tubes further employing $Cs_2MoO_4$ as the electron emissive material impregnated in the open pores of the thin metallic coating and with said electron emission means having been sintered on tungsten substrates of various electrode shapes. Sintering of the 1.35 micron size tungsten powder employed to form said porous metallic coatings was conducted at temperatures in the 1400°° C.-2000° C. temperature range with varying light output being experienced by the flash tube devices constructed therefrom. After 3,000 flashes of device operation the coating sintered at 1400° C. experienced 24–30% loss in light output as compared with 12–18% light output loss for sintering treatment at 1600° C. and with only 0–2% light output loss when the sintering temperature reached 1800°-2000° C. Such retention of light output in a tested device over a flash life of 3,000 flashes was not expected since conventional flash tubes of the same design but employing electrodes fabricated with pressed tungsten pellets only maintain light output relatively constant during 1500 flashes.

DESCRIPTION OF THE DRAWING

FIG. 1 is a double-ended tubular shaped glass flash tube 10 which includes a light transparent glass envelope 12 in the the form of an elongated closed tube 14 sealed at each end by a direct hermetic sealing to a pair of discharge electrodes 16 and 18 formed as hereinafter further explained. As can be noted, however, the cathode member 16 of said discharge molybdenum electrodes terminates within the flash tube envelope in a hair pin shape permitting closer proximity to the inner glass wall than is provided by a straight electrode end of the anode member 18. Such hair pin termination has the beneficial effect of reducing the operating voltage requirements in the flash tube device. An electron emissive coating 21 is deposited on the hair pin termination of electrode member 16 serving as the cathode element of the flash tube while remaining discharge electrode 18 remains bare molybdenum metal. Ionization of a xenon filling contained within the closed tube 14 produces an electrical discharge between said electrode ends when an electrical pulse of sufficient potential is applied. A transparent electrically conductive coating 22 is deposited on the exterior surface of the glass tube providing starting electrode means to initiate the xenon discharge and with said auxiliary electrode means being electrically connected by an electrical terminal 24 to a source of high frequency high voltage current in the customary manner.

To prepare the novel cathode member in the above illustrated device a molybdenum shank having the bent configuration can be simply dipped into a liquid suspension of tungsten and tantalum metal powder mixture having a approximate 1 micron diameter average particle size and which further includes a conventional organic binder, such as Retan, to promote initial adherence of of the coating. Air drying of the coating followed by firing the dried coating in a hydrogen atmosphere at temperatures in the 1400° C.-2000° C. temperature range produces a 0.1–0.2 millimeter thickness sintered metallic porous layer on the bent molybdenum shank. In the particular flash tube embodiment being illustrated, a $Cs_2MoO_4$ emission material was impregnated into said porous metal layer in a conventional manner to produce the final cathode member. Superior device performance was observed, on the other hand, when said impregnation was carried out with a liquid suspension of the emission material in alcohol as compared with aqueous suspensions.

The selection of a tungsten mixture containing up to about 100 weight percent tantalum metal as the coating matrix in the above illustrated embodiment affords certain advantages. Lower sintering temperatures are achieved for said mixtures when compared with tungsten metal alone which is beneficial. Of possibly greater benefit is the chemical reducing effect of tantalum as compared with tungsten during operation of the flash tube device. More particularly, the $Cs_2MoO_4$ emissive material dispersed in the pores of the sintered coating is reduced more effectively by tantalum to furnish cesium ion continuously during said device operation which desirably lowers the work function of this cathode member. Such lower work function generally provides higher light output in the device over the entire life cycle and can lower the voltage requirements to a significant degree.

Figure 1:
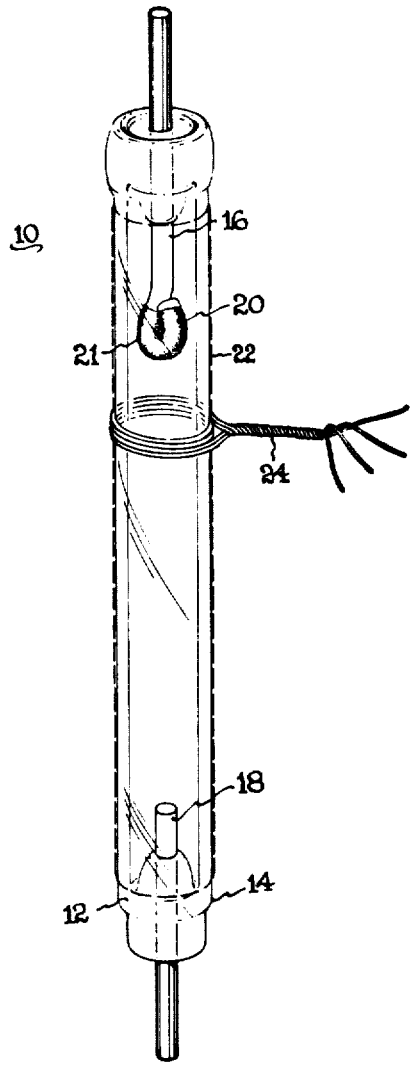
FIG. 1 is a perspective view of a preferred glass flash tube construction employing the present electrode members in a hair pin design configuration.
Figure 2:
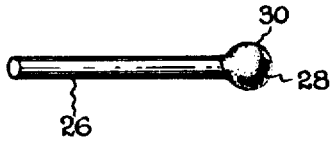
FIG. 2 is a cross-section of a different cathode member constructed in accordance with the present invention.

In FIG. 2 there is depicted in cross-section a different preferred cathode member 26 of the present invention which terminates in a balled end 28 serving as the refractory metal substrate on which the porous metallic coating 30 is sintered. Said balled end termination can be formed by simply melting back one end of the refractory metal shank as well as by employing other conventional techniques. It is thereby possible to produce a variety of electrode shapes on which the cathode structure of the present invention can be sintered as above described.

It will be apparent to those skilled in the art that various modifications may be made within the scope of the present invention. For example, other flash tube configuration than above specifically disclosed as well as discharge lamps such as that described in the previously referenced pending application Ser. No. 161,431 can be modified beneficially to incorporate the present cathode member. It is intended to limit the present invention, therefore, only by the scope of the following claims.

What we claim as new and desire to secure by U.S. Letters Patent is:

1. An improved method of forming an electric discharge cathode member for an electric discharge lamp which comprises:

(a) applying a liquid suspension of refractory metal particles selected from tungsten and tantalum metals, including mixtures thereof with an organic binder to a refractory metal substrate at a coating thickness not to exceed about one millimeter thickness, (b) sintering said refractory metal particles in a reducing atmosphere at an elevated temperature of at least 1800° C. to form a porous coating adhered to said refractory metal substrate, and (c) impregnating the porous coating with a liquid suspension containing $Cs_2MoO_4$ emission material in alcohol.

* * * * *